US005436976A

United States Patent [19]

Dougherty

[11] Patent Number: 5,436,976

[45] Date of Patent: Jul. 25, 1995

[54] OMNI-DIRECTIONAL STEREO SPEAKER

[76] Inventor: Donald J. Dougherty, Rte. 1, Box 288, Callaway, Va. 24067

[21] Appl. No.: 254,415

[22] Filed: Jun. 6, 1994

Related U.S. Application Data

[63] Continuation of Ser. No. 997,198, Dec. 28, 1992, abandoned.

[51] Int. Cl.[6] ..... H04R 1/02

[52] U.S. Cl. ..... 381/88; 381/186; 381/188; 381/205; 181/144; 181/153; 181/199

[58] Field of Search ..... 381/188, 205, 88, 90, 381/87, 186, 182; 181/199, 144, 153, 198, 146

[56] References Cited

U.S. PATENT DOCUMENTS

| | | | |
|---|---|---|---|
| 4,016,953 | 4/1977 | Butler | 381/89 |
| 4,249,037 | 2/1981 | Dexter | 181/144 |
| 4,501,934 | 2/1985 | Wiener | 381/90 |
| 4,673,057 | 6/1987 | Glassco | 188/199 |
| 4,837,837 | 6/1989 | Taddeo | 181/146 |
| 5,097,514 | 3/1992 | McNeil | 381/182 |

FOREIGN PATENT DOCUMENTS

| | | | |
|---|---|---|---|
| 836862 | 4/1952 | Germany | 181/153 |

*Primary Examiner*—Curtis Kuntz
*Assistant Examiner*—Ping W. Lee

[57] ABSTRACT

An omni-directional stereo speaker especially useful in high fidelity sound reproduction applications, comprised of a polyhedron speaker enclosure, separate speakers or drivers mounted in some or all of the faces of the polyhedron enclosure, an acoustically transparent cover or outer housing for the enclosure, and a mounting means for positioning the speaker unit away from walls or other flat reflecting surfaces so as to provide an aural stereo effect throughout a room or other limited space. The polyhedron enclosure and multiplicity of speakers therein approaches ideal spheroidal projection of the reproduced sound wave, i.e. the sound appears to be emanating from a point source, and thereby produces a realistic stereo sound image in all parts of the room.

5 Claims, 6 Drawing Sheets

FIG 3
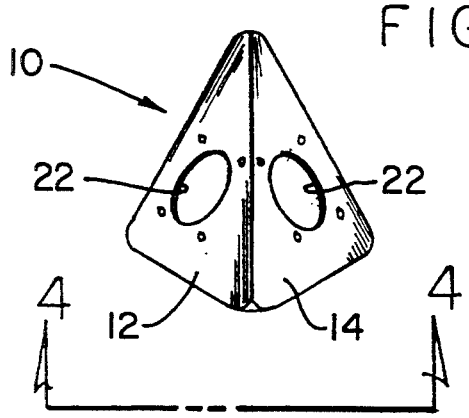
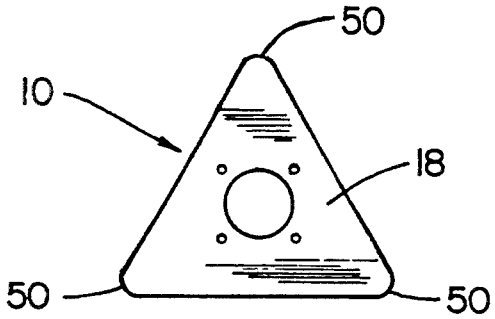
FIG 4
FIG 5
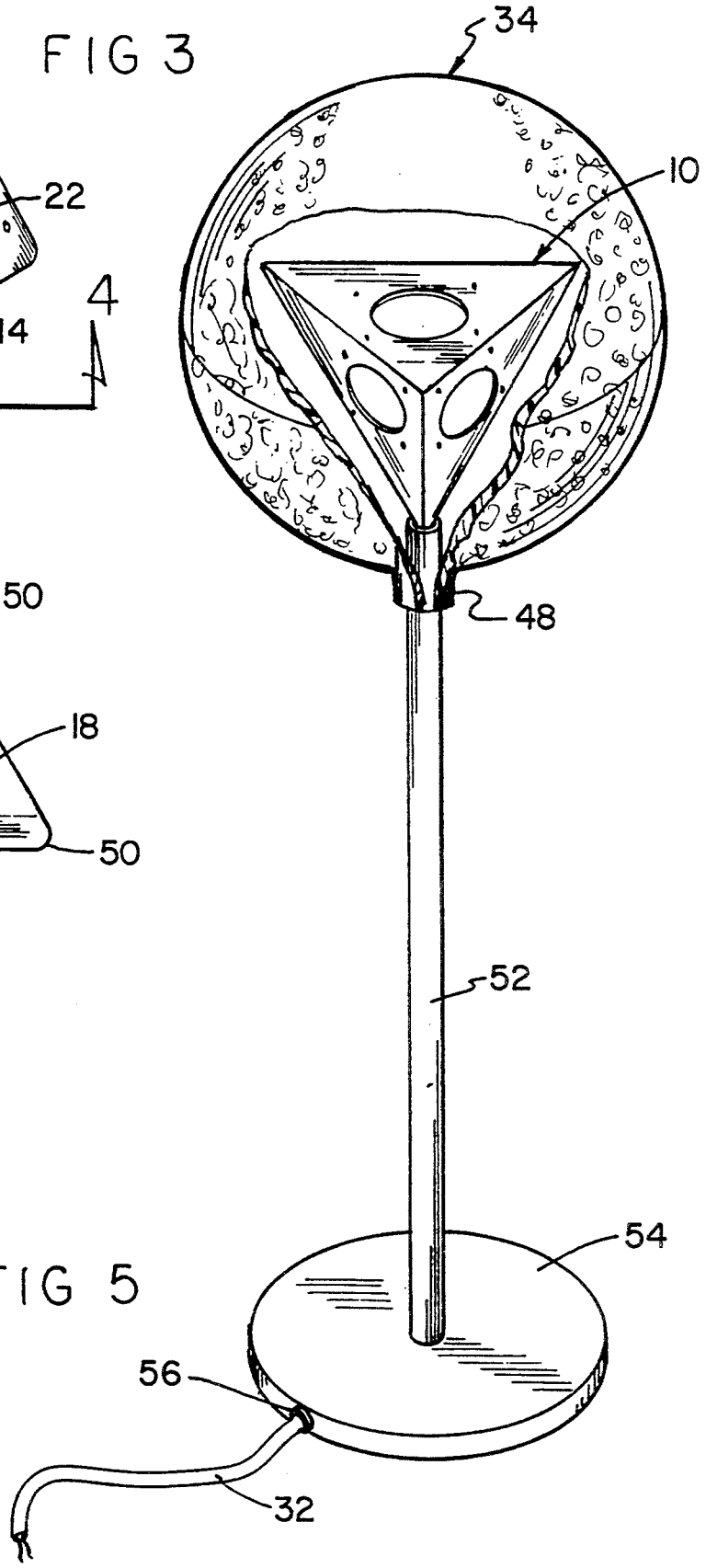

OMNI-DIRECTIONAL STEREO SPEAKER

This application is a continuation of application Ser. No. 07/997,198, filed Dec. 28, 1992, now abandoned.

BACKGROUND OF THE INVENTION

1. Field of the Invention

The present invention relates generally to audio speaker systems, and more particularly, to an omni-directional stereo speaker adapted to be positioned in free space away from reflecting walls so as to achieve a more realistic stereo sound than is otherwise obtainable with box-like speaker enclosures positioned adjacent a wall Or other flat surface.

2. Description of the Prior Art

Conventional speaker enclosures for reproducing so-called stereo sound attempt to simulate a pair of spaced point sources emanating from a flat vertical wall. Thus, the typical stereo speaker configuration comprises a pair of rectangular shaped boxes each having a speaker, or a multiplicity of speakers mounted on the front face thereof, the pair being positioned in a spaced manner against a vertical wall surface. Each speaker, in turn reproduces a slightly different audio signal, i.e. a right channel and a left channel, which signals become blended in the space between the speakers and away from the wall. A listener positioned in that space will perceive the blended signal as having both lateral and depth components and this effect, known as the "stereo effect" will impart a sense of realism to the reproduced sound. When a pair of spaced "stereo" speaker boxes or enclosures are placed against a flat reflecting surface such as wall, for example, an arrangement typical in a great many installations, portions of the sound wave being reproduced by each speaker are reflected from the wall giving rise to interference patterns with respect to the sound being directly radiated into the listening space. The interference patterns result in unintended reinforcement and cancellation of portions of the radiated sound which, in turn, produces a form of distortion, the net effect of which is to lessen the extent of realism of the reproduced sound, and produce a flattened sound stage. For example, musical instruments which should be perceived or heard as being located in an orchestra on the left often seem to wander back and forth across the sound stage. Similarly, a vocalist, who should be in the center of the sound stage, might sound as if he or she is on the left, or the right, or worse yet, suspended in space unnaturally high up on the wall behind the speakers.

In order to ameliorate this problem, various prior art solutions have been proposed. Some speaker designs feature "bi-polar radiation," an arrangement where a speaker, or a plurality of speakers is mounted on the back of the enclosure in addition to the speaker or speakers mounted on the front surface of the enclosure. In such cases, it is usually necessary to move the speaker enclosures away from the wall and into the listening area to an extent where they undesirably interfere with furniture placement in the room. In U.S. Design Pat. No. 281,316 there is shown a speaker enclosure having speakers mounted on the adjacent sides of a rectangular box-like enclosure. Such a design requires that the speakers, for optimal performance be placed in the corners of a room. Similarly, in U.S. Pat. No. 3,720,787, a globular shaped housing having a plurality of speakers mounted on the spherical surface thereof is described.

In yet another example, namely U.S. Pat. No. 4,890,689, there is shown a twelve-sided housing wherein each of the sides is concavely shaped to "horn-load" a speaker mounted thereon. None of these patented designs is completely effective however in achieving an omni-directional stereo speaker system that is capable of producing a realistic point source stereo image yet be cost effective and therefore readily available to the consuming public.

The foregoing disadvantages are overcome by the unique omni-directional stereo speaker of the present invention as will be made apparent from the following description thereof. Other advantages of the present invention over the prior art also will be rendered evident.

SUMMARY OF THE INVENTION

To achieve the foregoing and other advantages, the present invention, briefly described, provides an omni-directional stereo speaker especially useful in high fidelity sound reproduction applications, comprises a polyhedron speaker enclosure, separate speakers or drivers mounted in some or all of the faces of the polyhedron enclosure, an acoustically transparent cover or outer housing for the enclosure, and a mounting means for positioning the speaker unit away from wails or other flat reflecting surfaces so as to provide an aural stereo effect throughout a room or other limited space. The polyhedron enclosure and multiplicity of speakers therein approaches ideal spheroidal projection of the reproduced sound wave, i.e. the sound appears to be emanating from a point source, and thereby produces a realistic stereo sound image in all parts of the room.

The above brief description sets forth rather broadly the more important features of the present invention in order that the detailed description thereof which follows may be better understood, and in order that the present contributions to the art may be better appreciated. There are, of course, additional features of the invention that will be described hereinafter and which will form the subject matter of the claims appended hereto.

In this respect, before explaining several preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved omni-directional stereo speaker which has all of the advantages of the prior art and none of the disadvantages. It is another object of the present invention to provide a new and improved omni-directional stereo speaker which may be easily and efficiently manufactured and marketed.

It is a further objective of the present invention to provide a new and improved omni-directional stereo speaker which is of durable and reliable construction.

An even further object of the present invention is to-provide a new and improved omni-directional stereo speaker which is capable of a low cost of manufacture with regard to both materials and labor, and which accordingly is then capable of low prices of sale to the consuming public, thereby making such omni-directional stereo speaker available to the buying public.

Still yet a further object of the present invention is to provide a new and improved omni-directional stereo speaker capable of producing a realistic point source stereo sound image.

It is still a further object of the present invention to provide a new and proved omni-directional stereo speaker that may be located anywhere in a room and still produce an accurate stereo sound image.

Still a further object of the present invention is to provide a new and improved omni-directional stereo speaker including polyhedron shaped enclosure means for a plurality of speakers.

Yet still a further object of the present invention is to provide a new and improved omni-directional stereo speaker including polyhedron shaped enclosure means for a plurality of speakers positioned inside a spherical shaped outer housing.

An even further object of the present invention is to provide a new and improved omni-directional stereo speaker system including mounting means therefor facilitating placement of the speaker system away from the fiat reflecting vertical walls of the room yet in such a manner as not to interfere with the placement of furniture in the room.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein:

FIG. 3 is a perspective view of an alternatively preferred form of the omni-directional stereo speaker of the invention.

FIG. 4 is a bottom view of the alternatively preferred embodiment of FIG. 3.

FIG. 5 is a perspective view of the speaker enclosure of FIG. 1 mounted on a floor standing pedestal.

DESCRIPTION OF THE PREFERRED EMBODIMENT

With reference now to the drawings, a new and improved omni-directional stereo speaker embodying the principles and concepts of the present invention will be described.

Figure 1:
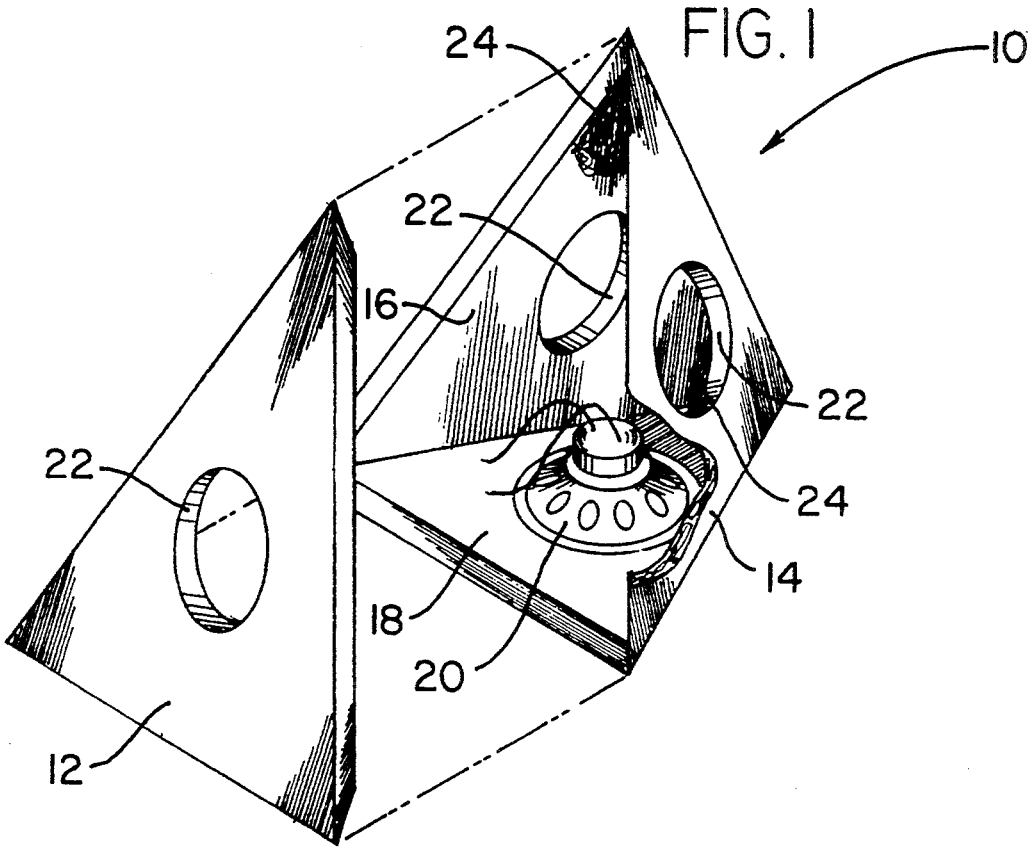
FIG. 1 is a perspective exploded view showing the first preferred embodiment of the omni-directional stereo speaker of the invention.
Figure 2:
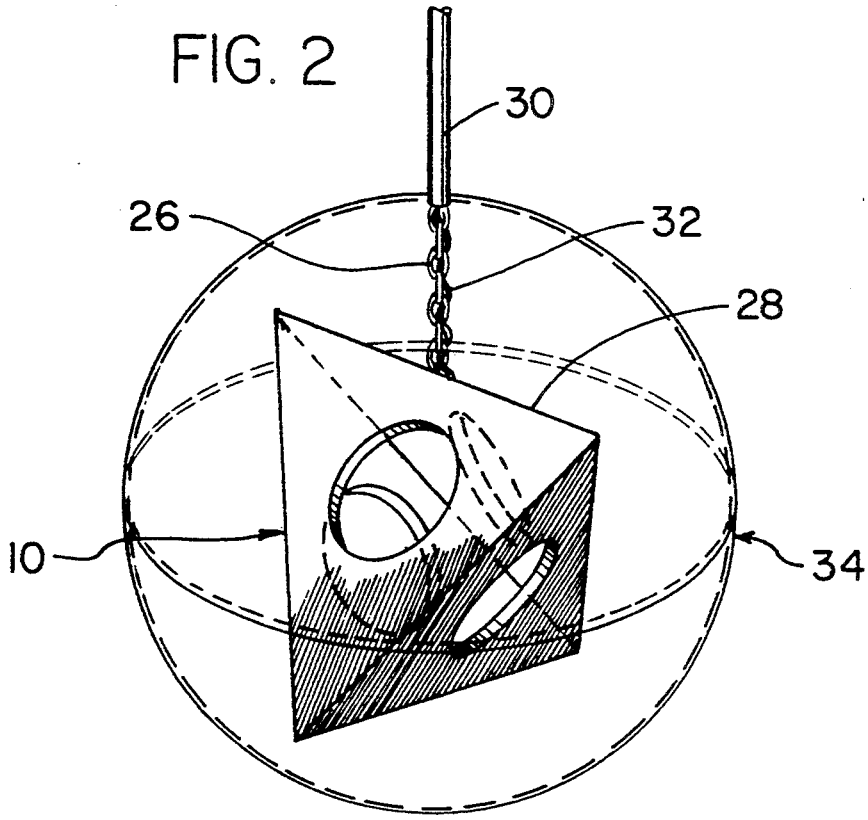
FIG. 2 is a perspective elevational view of the omni-directional stereo speaker of FIG. 1 mounted in a spherical housing and adapted to be hung from a ceiling.
Figure 11:
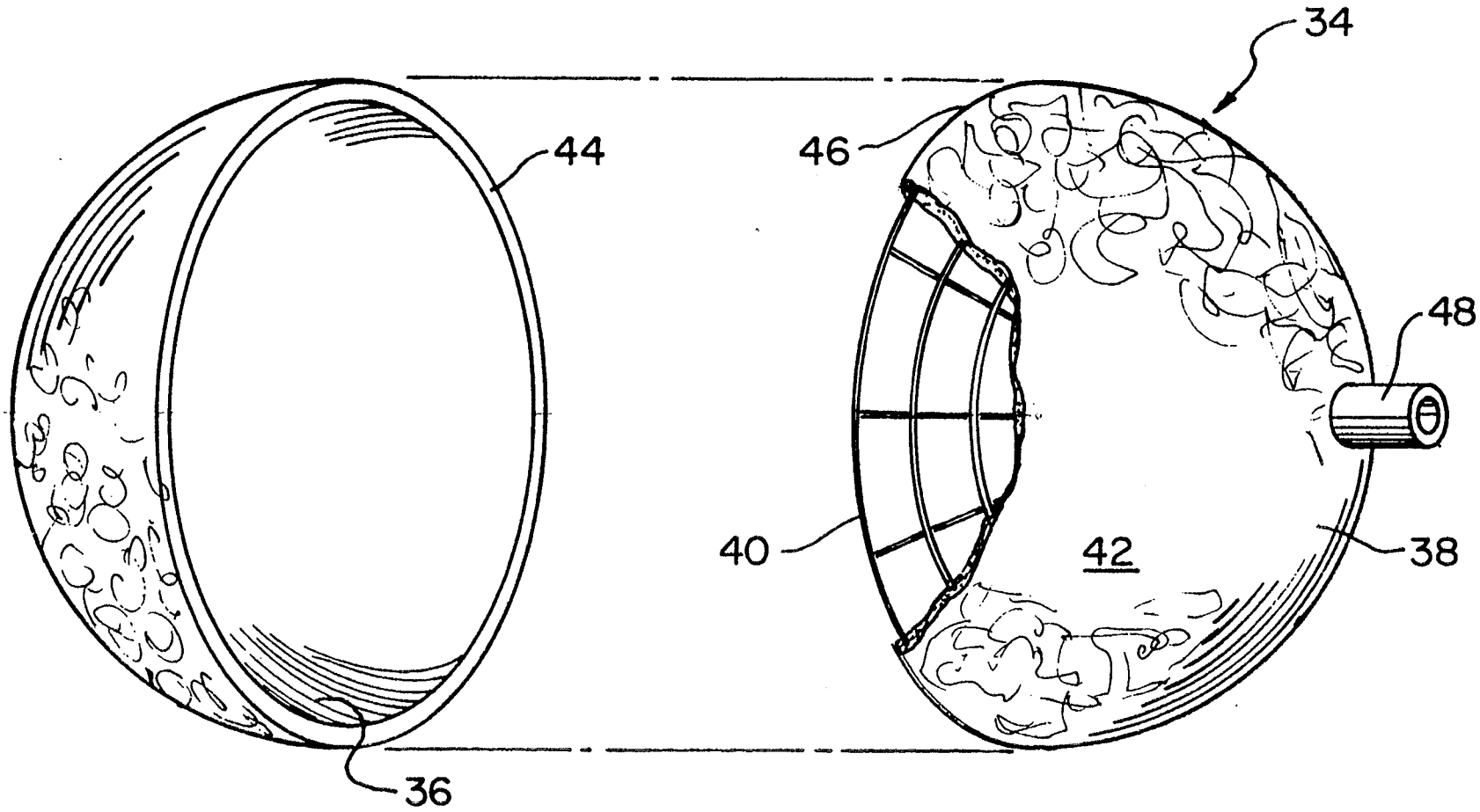
FIG. 11 is an exploded perspective view of the outer spherical housing of the invention.

Turning initially to FIGS. 1, 2 and 11, there is shown a first exemplary embodiment of the omni-directional stereo speaker of the invention which in its preferred form comprises a polyhedron speaker enclosure generally designated by reference numeral 10. More specifically, enclosure 10 comprises a regular tetrahedron having four triangular shaped sides 12, 14, 16, and 18. On the inside surface of each side of the enclosure there is suitably mounted a conventional full-range audio speaker or driver 20 concentrically and coaxially with respect to a complimentary sized circular opening 22 (only one speaker being shown in FIG. 1 for the sake of clarity). Preferably, a separate wad of acoustically absorbent material 24 is placed in the vertices of the tetrahedron enclosure before it is sealed to damp standing waves and/or internal reflections as is generally understood in the stereo speaker art. Considerably less absorbent material is required than would be the case with a rectangular shaped enclosure having parallel spaced walls because the walls of the tetrahedron shaped enclosure being at an acute angle to one another render it inherently less susceptible to the generation of internal standing waves. For this same reason, the tetrahedron shaped enclosure according to the invention experiences less vibration for a given sound output and therefore a cleaner, less resonant sound than box-like enclosures using similar drivers. Preferably, the sides of the tetrahedron are tightly sealed with respect to each other so that the enclosure forms an "infinite baffle" enclosure. Likewise, the speakers 20 preferably are of the well-known movable-coil dynamic type having a driven cone or diaphragm mounted on a compliant suspension. This combination is frequently referred to as an "air-suspension" design.

In FIG. 2, there is shown a preferred method and means for positioning enclosure 10 in a room or other space. A ceiling mount is provided comprising a chain 26 suitably attached at one of its ends to the midpoint of the edge 28 formed by the intersection of two adjacent sides of the tetrahedron enclosure 10 substantially as shown. The other end of the chain is mounted through a conventional ceiling mounting bracket assembly (see FIG. 7) to an electrical outlet box in the ceiling of a room. The chain preferably is encased in a hollow tube or pipe 30. Also passing through the hollow tube or pipe is a pair of electrical leads or wires 32 for carrying suitable electrical signal power to the speakers in the enclosure. In this regard, it will be noted that the other ends of electrical wires 32 eventually are connected to the speaker outputs, preferably 8 ohm output terminals, on a conventional audio amplifier, not shown and not forming any part of the present invention.

Inside enclosure 10, wires 32 are suitably connected to the various speakers 20 by a well known series/parallel combination such that the total impedance of the array of four speakers is approximately 8 ohms or the same as that of the amplifier output terminals, thus providing a smooth electrical impedance match. In addition, the wires are connected to the terminals on each speaker to assure that they operate in phase, i.e. the cone or diaphragm of each speaker will move in unison in the same direction with respect to the others when an electrical input signal is impressed on conductors 32.

Covering the tetrahedron enclosure 10 is a spherical outer housing 34 of acoustically transparent character. As better viewed in FIG. 11, the spherical outer housing member 34 preferably comprises a pair of interfitting hemispherically shaped members 36, 38 each fabricated of a conventional acoustically open or transparent material 42 such as cloth or foam. The material is shaped or stretched over a wire or plastic mesh supporting framework 40 and attached thereto by any suitable means. The two hemispherical members 36, 38 preferably are snapped into interfitting engagement with each other along their equatorial confronting edges 44, 46 by suitable known clip fasteners (not shown) with their inside surfaces resting on the vertices of the enclosure 10. This arrangement is diagrammatically indicated in FIG. 2. A tubular shaped protrusion 48 is provided in axial alignment with one of the hemispherical members 38 to provide a collar adapted to receivingly engage the bottom end of pipe 30.

A pair of speaker assemblies each comprising enclosure 10 inside spherical outer housing or cover 34 may be hung from the ceiling of a room in a spaced manner with respect to each other and positioned in the room for optimum stereo effect. As a result of the arrangement of four speakers in the four sides of the tetrahedron enclosure as contemplated by the present invention, the speaker array (enclosure 10) closely approximates a spherical radiator, directing the sound wave energy in all directions, i.e. the speaker assembly essentially becomes a point source sound radiator. This, in turn, enables a three-dimensional stereo image to be perceived and clearly heard any where in the room advantageously overcoming the limitations of box-like stereo enclosures placed against a wall. Moreover, by hanging the speaker assemblies from the ceiling, dispersion is uniform throughout the room (no dead spaces), and the effects of furniture and other acoustic room modifiers are virtually eliminated. Moreover, furniture arrangement is not compromised as the speaker systems of the invention may be hung from the ceiling of a room at convenient selective locations.

Without limiting the present invention, a speaker system configuration in accordance with the above principles has been fabricated using an outer spherical housing of 14" diameter, a regular tetrahedron core enclosure having 14" sides measured vertex to vertex, and four commercially available dual-cone full range speakers each having a 6" mounting diameter mounted in each of the sides of the tetrahedron, respectively. The systems were hung from a ceiling at a height of about 18" inches measured from the ceiling to the central horizontal plane of the spherical outer housing, were spaced about 7 feet apart center-to-center with each speaker being spaced approximately 2 feet in from the nearest vertical wall. The stereo image of musical program information reproduced by this speaker configuration remained stable and positioned between the speakers, and overall sound quality was not diminished by varying the listener's location within the room.

In order to increase the size of the speakers and/or the volume of enclosure 10 without increasing the size of outer spherical housing member 34, the vertices of the tetrahedron may be cut or truncated by prodding each panel or side with rounded corners 50. This alternatively preferred arrangement is illustrated in FIGS. 3 and 4. When the vertices are rounded off, a hole or open space will be present at each truncated vertex of the enclosure. However, by stuffing each opening at the rounded vertices with the wad 24 of absorbent acoustical material (e.g. felt, wool batting, fiberglass) the overall frequency response of the speaker array essentially is unaffected as any loss in the quality of the infinite baffle brought about by the open vertices (and therefore a decrease in low frequency response) is more than offset by the increase in speaker and/or volume size. Furthermore, the provision of openings at the vertices damped by acoustically absorbent material in accordance with the invention actually smoothes the frequency response characteristics of the enclosure especially in the low and midbass range.

An alternative method of mounting the speaker assembly of the invention is shown in FIG. 5. Enclosure 10 has one vertex supported at the top end of a tubular pedestal 52 by suitable bracket means (not shown) whereas the other or bottom end of the pedestal is suitably attached to a circular floor plate which is weighted sufficiently to stabilize the pedestal, but which may selectively be moved to various positions in a listening room. The spherical outer housing 34 has its tubular protrusion 48 engaging the top end of pedestal 52 substantially as shown. The speaker leads 32 enter the floor plate through grommet 56 and extend through the hollow interior of tubular pedestal 52 ultimately entering enclosure 10 at the supporting vertex. Pedestal mounting of the speaker assembly as shown in FIG. 5 offers the added advantage of being able to move the speaker to different positions in the room and is desirable in those cases where and when ceiling mounting is inappropriate or inconvenient.

Figure 6:
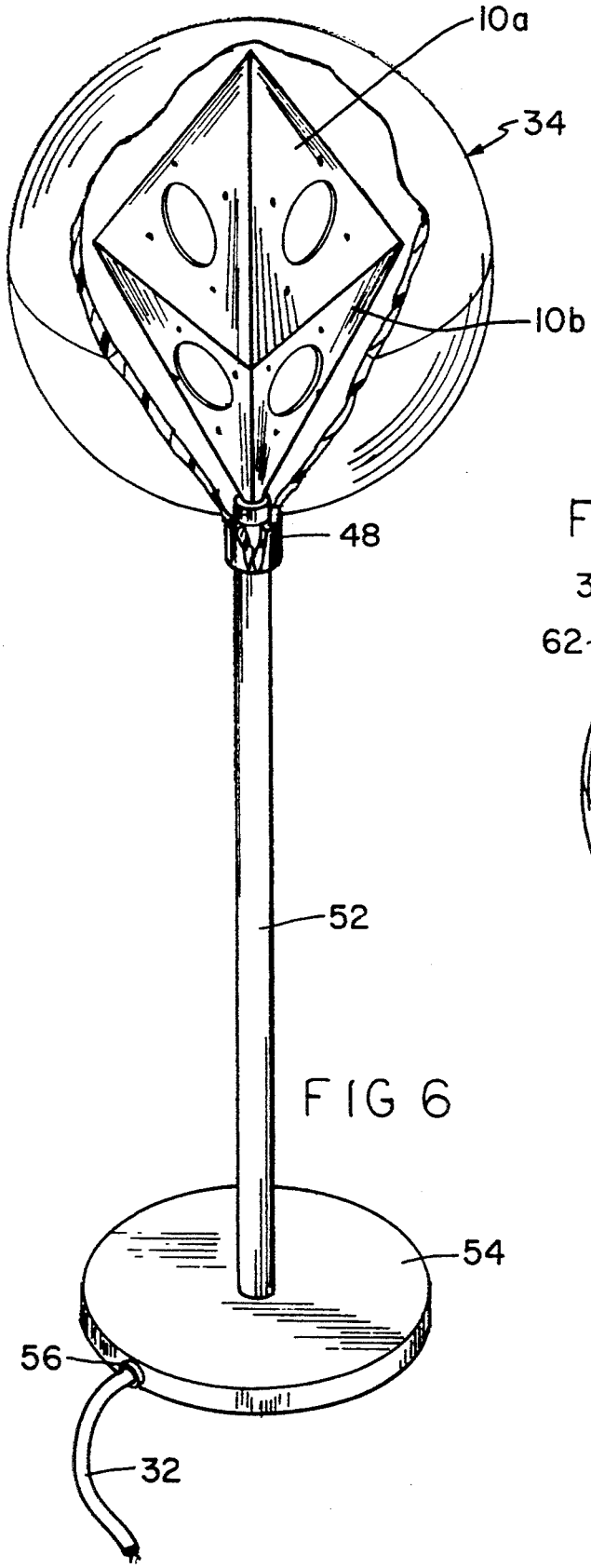
FIG. 6 is a perspective view of an alternatively preferred version of the floor pedestal mounting arrangement of FIG. 5.

Polyhedron enclosures having different shapes may be used to practice the present invention. In FIG. 6, there is shown an alternatively preferred form of speaker enclosure comprising a pair of tetrahedrons 10*a* and 10*b* attached together along a common side and supported by the pedestal floor mount of FIG. 5.

Figure 7:
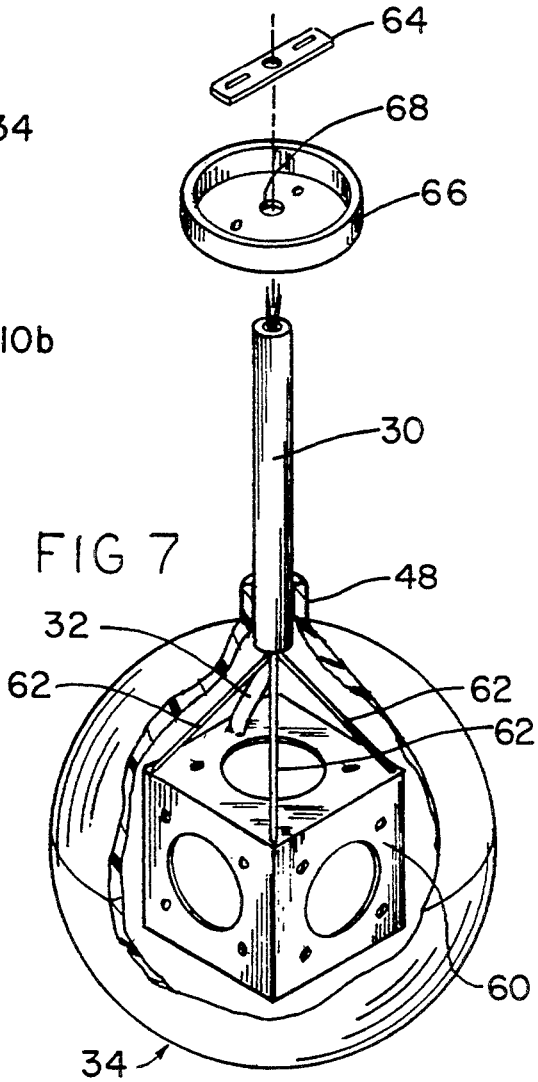
FIG. 7 is yet another alternatively preferred embodiment showing a modified polyhedron enclosure with a ceiling mount outer enclosure.

In FIG. 7, there is shown a speaker enclosure comprising a cube 60 having six sides and a speaker mounted in each side. A cube is less efficient than a tetrahedron, for example, because a larger spherical outer housing is required and no substantial gains in frequency response, dispersion, and stereo imaging are obtained for a given speaker. In the arrangement of FIG. 7, the speaker cube is supported by a series of support straps 62 connected between the cube itself and a support bracket 64 mounted in a conventional outlet box in the ceiling. The electrical leads 32 for energizing the speakers extend through pipe 30 to the outlet box in the ceiling. A cap plate 66 may be provided engaging pipe 30 where it enters the ceiling to provide an attractive finish with the top end of the pipe extending through a central opening 68 in the cap plate. The latter may be attached to bracket 64 via suitable screw fasteners engaging bracket 64 in a known manner.

Figure 8:
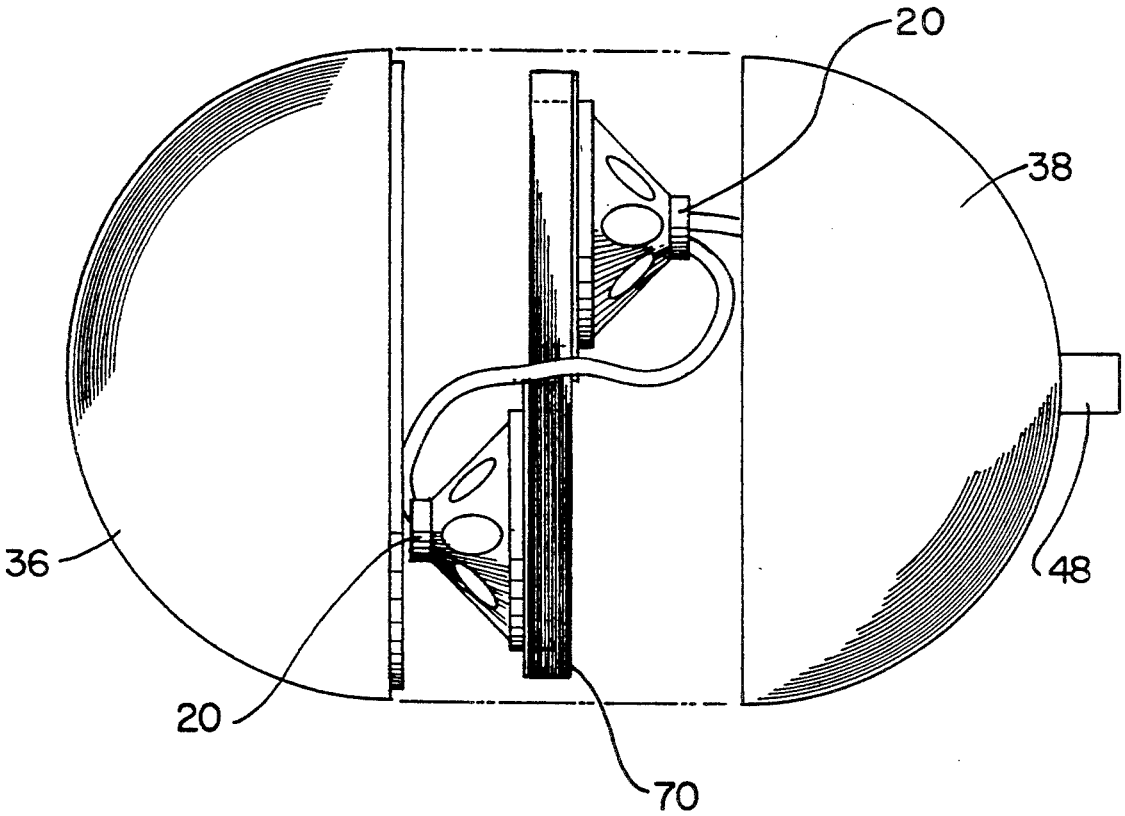
FIG. 8 is an elevational view of a lower cost version alternative embodiment of the invention.

A low cost or "budget" version of the invention is shown schematically in FIG. 8 and comprises a circular flat plate 70 having a plurality of speaker units 20 mounted thereon preferably, two such units, facing in opposite directions. The hemispherical outer housing members 36, 38 are snapfitted together about plate 70 and the leads for the speaker array brought out through tubular protrusion 48 as before. This embodiment may be ceiling mounted or pedestal mounted in the same manner as the prior embodiments, but will have less dispersion and less extended low frequency response than the prior embodiments.

Figure 9:
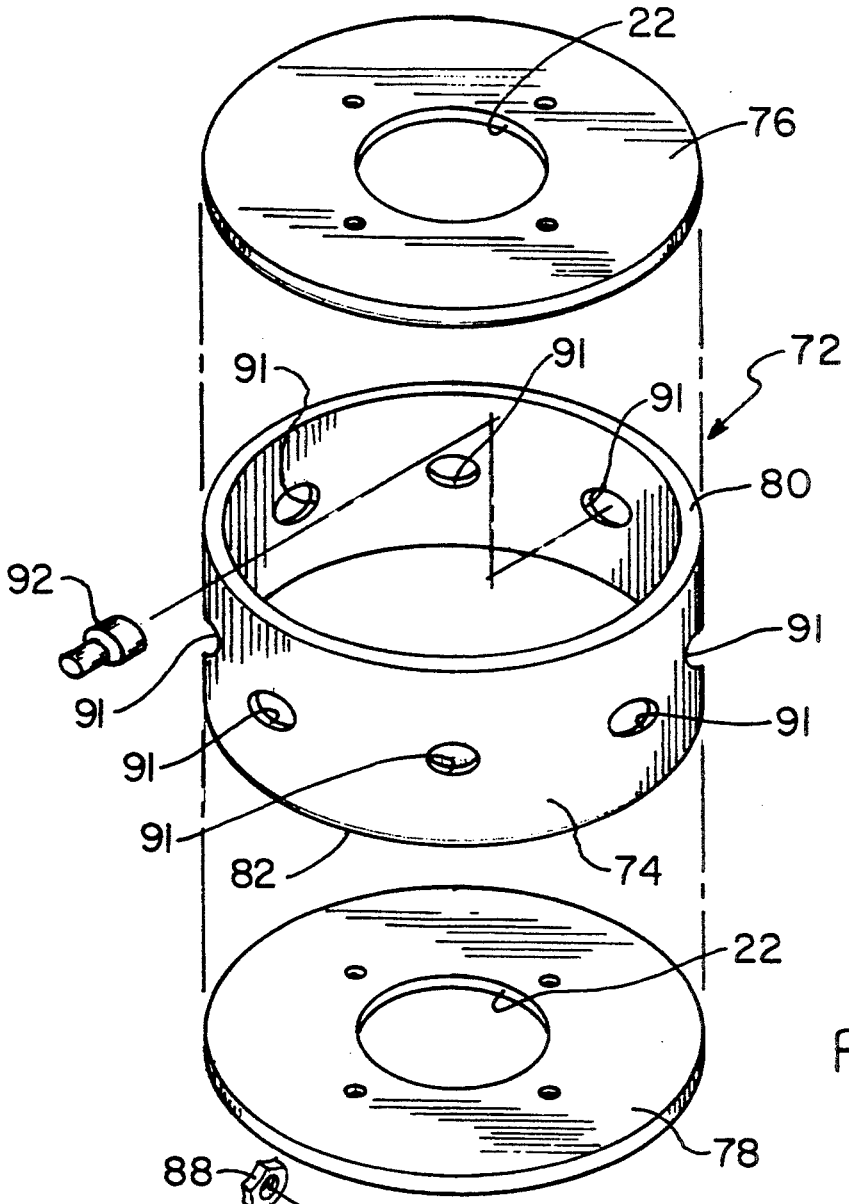
FIG. 9 is an exploded perspective view of a modified form of the alternative embodiment of FIG. 8.
Figure 10:
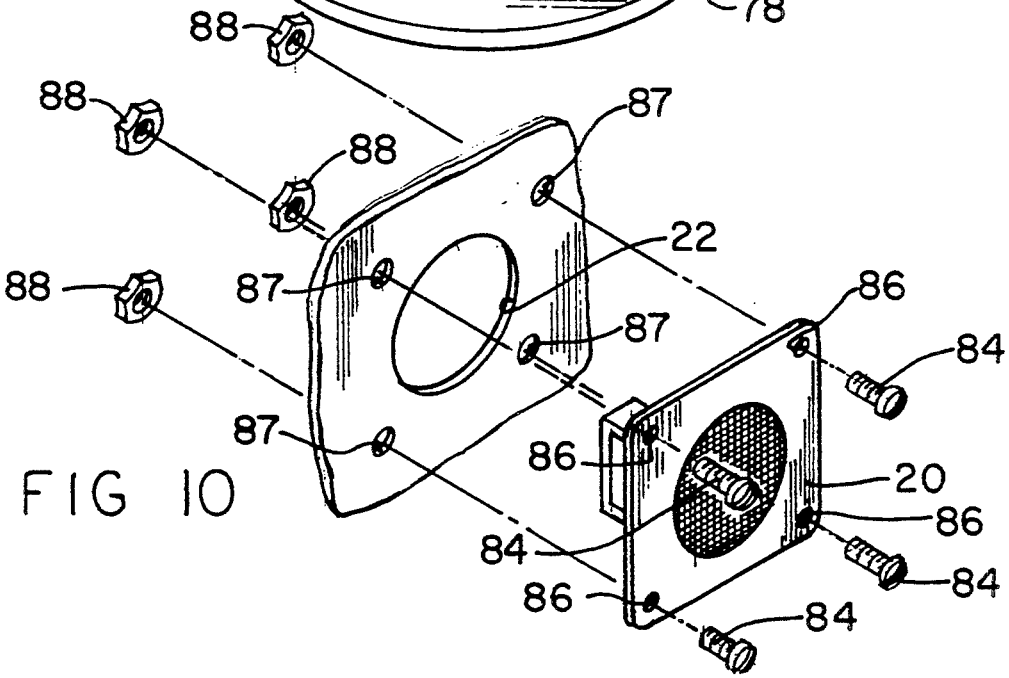
FIG. 10 is a perspective view of a portion of the embodiment of the invention of FIG. 9 showing how a speaker is mounted to a baffle thereof.

A modified, higher quality version of the arrangement shown in FIG. 8 is illustrated in FIGS. 9 and 10. As depicted therein, a cylindrically shaped enclosure generally designated by reference numeral 72 is employed in lieu of flat plate 70. Enclosure 72 comprises a cylindrical wall member 74, and a pair of flat circular shaped baffle plates 76, 78 adapted to be suitably attached to the opposed circular edges 80, 82 of the wall member, respectively, to form a sealed infinite baffle enclosure. Each baffle plate 74, 76, in turn, has a central opening 22 in which a speaker 20 is mounted via screw fasteners 84 extending through holes 86, 87 in the speaker frame and the baffle plate, respectively, and engaging nut fasteners 88 (FIG. 10). Cylindrical wall member 74 has disposed therein substantially as shown a multiplicity of holes 91 each generally designated by reference numeral 90 extending evenly spaced about the circumference thereof. A like series of plugs 92 (only one shown) sized to tightly fit and frictionally engage each hole respectively is provided to tune the sealed enclosure. Thus, by removing one or more of the plugs before attaching plates 76, 78, the enclosure optionally may be converted to a ported enclosure and the enclosure thereby tuned for a given type of speaker 20 or for a given type of sound desired. Enclosure 72 may be fitted with a spherical outer cover or housing as in FIG. 8 and either ceiling mounted or pedestal mounted in the same manner described previously with respect to prior preferred embodiments of the invention.

It is apparent from the above that the present invention accomplishes all of the objectives set forth by providing a new and improved omni-directional stereo speaker capable of producing a realistic point source stereo sound image, which may be located anywhere in a room and still produce a stable and accurate stereo sound image, and which includes a polyhedron shaped enclosure means housing a plurality of speakers mounted in a spherical housing adapted to be hung from a ceiling or mounted on a movable floor pedestal.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein. For example, although the preferred embodiments of the invention utilize a single full-range speaker mounted on each side of a polyhedron enclosure, a separate woofer and tweeter with a suitable cross-over or frequency dividing network may be employed instead. Hence, the proper scope of the present invention should be determined only by the broadest interpretation of the appended claims so as to encompass all such modifications and equivalents.

What is claimed as being new and desired to be protected by LETTERS PATENT of the United States is as follows:

1. An omni-directional electroacoustical speaker comprising:

a polyhedron enclosure, speaker means mounted on one or more of the sides of said polyhedron enclosure, an outer acoustically transparent housing covering said enclosure, and means for positioning said enclosure and said covering in a room spaced from the walls of said room, wherein said polyhedron enclosure is a tetrahedron, wherein said tetrahedron comprises four substantially flat triangular shaped sides each having three edges, each of said three edges of each of said substantially flat sides intersecting the other two of said three edges of said substantially flat side in arcuate edges to define a rounded vertex at each of the three corners of each said substantially flat side, such that the vertices of said tetrahedron enclosure are defined by openings having three arcuate shape intersecting sides each one of which corresponds to the rounded vertex of a different substantially flat side respectively.

2. The apparatus of claim 1 wherein said outer housing is spherically shaped, and said enclosure further includes means for hanging said enclosure and said covering from a ceiling in said room.

3. The apparatus of claim 1 wherein said outer housing is spherically shaped, and said enclosure further includes means for supporting said enclosure on a pedestal, said pedestal having floor engaging means facilitating movement of said pedestal on said floor whereby the position of said enclosure and said pedestal in said room is selectively adjusted.

4. The apparatus of claim 3 wherein said floor engaging means is a weighted plate.

5. The omni-directional electroacoustical speaker of claim 1 wherein acoustical damping material is disposed inside said enclosure adjacent to each of said openings at said vertices thereof.

* * * * *